US007581788B1

(12) United States Patent
Johnson

(10) Patent No.: US 7,581,788 B1
(45) Date of Patent: Sep. 1, 2009

(54) COVER FOR LOUNGE CHAIR

(76) Inventor: Marvin H. Johnson, P.O. Box 553, Hemingway, SC (US) 29554

( * ) Notice: Subject to any disclaimer, the term of this patent is extended or adjusted under 35 U.S.C. 154(b) by 0 days.

(21) Appl. No.: 12/150,422

(22) Filed: Apr. 28, 2008

(51) Int. Cl.
*A47C 27/00* (2006.01)
*A47C 7/62* (2006.01)

(52) U.S. Cl. ..... 297/229; 297/184.11; 297/188.01

(58) Field of Classification Search ..... 297/229, 297/224, 184.1, 220, 184.11, DIG. 6, 188.01
See application file for complete search history.

(56) References Cited

U.S. PATENT DOCUMENTS 4,536,028 A 8/1985 Jones et al.
4,671,568 A 6/1987 Greer
4,725,094 A 2/1988 Greer
4,892,353 A 1/1990 Goddard
5,275,463 A * 1/1994 Rocha ..... 297/229
5,326,152 A 7/1994 Baron
5,620,229 A 4/1997 Ledford
5,624,157 A 4/1997 Kostuk
6,149,234 A 11/2000 Daniels
6,616,225 B2 9/2003 Graff

* cited by examiner

*Primary Examiner*—Milton Nelson, Jr.
(74) *Attorney, Agent, or Firm*—P. Jeff Martin; The McGougan Law Firm, LLC

(57) ABSTRACT

A fitted cover for a lounge chair is disclosed. The fitted cover includes a plurality of pockets secured along the side edges thereof to allow for the storage of personal items. The fitted cover has an auxiliary pocket to allow for the storage of additional personal articles and to shield user's head or face against sun rays. The auxiliary pocket can be fixedly elevated in a variety of desired angular orientations.

2 Claims, 4 Drawing Sheets

COVER FOR LOUNGE CHAIR

RELATED APPLICATIONS

There are no previously filed, nor currently any co-pending applications, anywhere in the world.

BACKGROUND OF THE INVENTION

1. Field of the Invention

The present invention relates generally to towels for covering a lawn chair and, more particularly, to a fitted cover for a lawn or lounge chair of the type commonly utilized at a swimming pool or a beach.

2. Description of the Related Art

It is a well known and common practice for sunbathers to employ portable lawn or lounge chairs at beaches and swimming pools to lie on for relaxation. Often times, towels or sheets are used to cover the lounge chairs for comfort and sanitation purposes. However, the towels and blankets are subject to being blown away when the chair is unoccupied.

In addition, sunbathing activity ordinarily involves the use of various personal items such as sunglasses, beverages, suntan lotion, cellular phone, car keys, cigarettes, hats, and books. Furthermore, many sunbathers typically employ the use of an anchored umbrella or similar device to shield the sun's rays. This presents the cumbersome task of not only transporting the sheet, personal items, umbrella, and chair, but also in organizing and preventing loss or theft of the personal articles.

The prior art has attempted to address the aforementioned problems through the use of covers for lawn chairs, some of which providing pockets. However, the prior art has failed to provide a fitted cover for a lounge chair having a lightweight, integral shading device.

Accordingly, a need has arisen for a fitted cover for a lounge chair having an integral pocketed, shading device for shielding the user against sun rays in a manner which is quick, easy, and efficient. The development of the fitted cover for a lounge chair fulfills this need.

A search of the prior art did not disclose any patents that read directly on the claims of the instant invention; however, the following references were considered related.

The following patents disclose various covers for lounge chairs:

U.S. Pat. No. 4,892,353, issued in the name of Goddard;

U.S. Pat. No. 4,671,568, issued in the name of Greer;

U.S. Pat. No. 4,536,028, issued in the name of Jones et al.;

U.S. Pat. No. 6,149,234, issued in the name of Daniels;

U.S. Pat. No. 6,616,225 B2, issued in the name of Graff;

U.S. Pat. No. 5,326,152, issued in the name of Baron;

U.S. Pat. No. 4,725,094, issued in the name of Greer;

U.S. Pat. No. 5,624,157, issued in the name of Kostuk; and

U.S. Pat. No. 5,620,229, issued in the name of Ledford.

Consequently, a need has been felt for a fitted cover for a lounge chair having an integral pocketed, shading device for shielding the user against sun rays.

SUMMARY OF THE INVENTION

Therefore, it is an object of the present invention to provide a fitted cover for a lounge chair having an anterior pocket and a posterior pocket adapted to fit over respective U-shaped ends of a lounge chair.

It is another object of the present invention to provide a fitted cover for a lounge chair having a plurality of pockets secured along the side edges of the cover for storing personal items.

It is another object of the present invention to provide a fitted cover for a lounge chair having an auxiliary pocket for shielding a user's head or face against sun rays.

It is another object of the present invention to provide a cover constructed of a moisture absorbent fabric material such as terry cloth or cotton.

Briefly described according to one embodiment of the present invention, a fitted cover for a lounge chair is disclosed. The lounge chair is of the type commonly utilized at a swimming pool or a beach. The lounge chair includes a central frame section having an upper frame section and a lower frame section adjustably hinged thereto. The upper frame section, central frame section, and lower frame section are fabricated of aluminum tubing or similar material. The upper frame section and the lower frame section are adapted to be vertically tilted with respect to the central frame section, thereby allowing the upper and lower frame sections to be positioned in various desired angular orientations.

The lounge chair is supported on a pair of U-shaped, transversely-extending legs. User is supported atop the lounge chair by a support means comprised of contiguous transverse plastic strips suitably affixed to each frame section.

The fitted cover comprises an elongated, substantially rectangular panel having a perimeter defining an anterior end opposing a posterior end and a first side edge opposing a second side edge. The panel is slightly tapered at the anterior end and posterior end in order to shapely and sizably conform substantially to an outer periphery of the lounge chair. The panel is fabricated of a moisture absorbent fabric material such as terry cloth or cotton.

The cover further comprises an anterior pocket being sizably adapted to fit over one U-shaped tubular end of lounge chair, and a posterior pocket sizably adapted to fit over the opposing U-shaped tubular end of lounge chair.

An auxiliary pocket is provided, wherein auxiliary pocket functions to both shield user's head or face against sun rays and to allow for the storage of personal articles. The auxiliary pocket is secured via a sewing operation to the anterior end of panel about an upper end of the anterior pocket.

A plurality of pockets is secured thereto along the first side edge and the second side edge of cover. Each of the pockets is easily accessible by user when reclining on the lounge chair. The plurality of pockets are formed each having three closed sides and one open side. Each of the pockets defines an interior volume within which various personal articles and accessories such as sunglasses, beverages, suntan lotion, cellular phone, car keys, cigarettes, and books may be placed for safe storage.

An alternate embodiment of the present invention is disclosed, wherein a pair of support members are provided for supporting the auxiliary pocket in a raised position, thereby forming a canopy for shielding a user's head or face against sun rays. Upper ends of the support members are inserted within respective pockets secured to opposed upper side edges of the auxiliary pocket, and lower ends of the support members are inserted within respective pockets secured to the first side edge and second side edge of the cover, proximal to the anterior end thereof.

It is envisioned that the pair of support members are telescopically adjustable, thereby allowing the auxiliary pocket to be fixedly elevated in a variety of desired angular orientations.

The use of the present invention allows a user to removably attach a cover to a lounge chair, to store personal items in such cover, and to shield the sun's rays in a manner which is quick, easy, and efficient.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
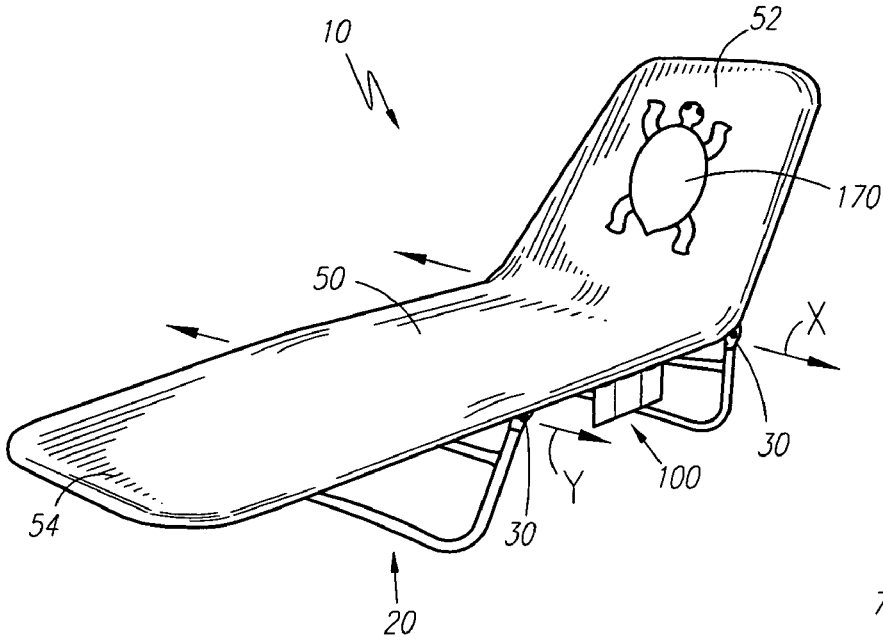
FIG. 1 is a perspective view of a cover as fitted to a lounge chair, according to the preferred embodiment of the present invention.

Referring now to FIG. 1, a fitted cover for a lounge chair 10, hereinafter cover 10, according to the present invention, is provided, wherein cover 10 is shown detachably fitted to the lounge chair 20.

Figure 2:
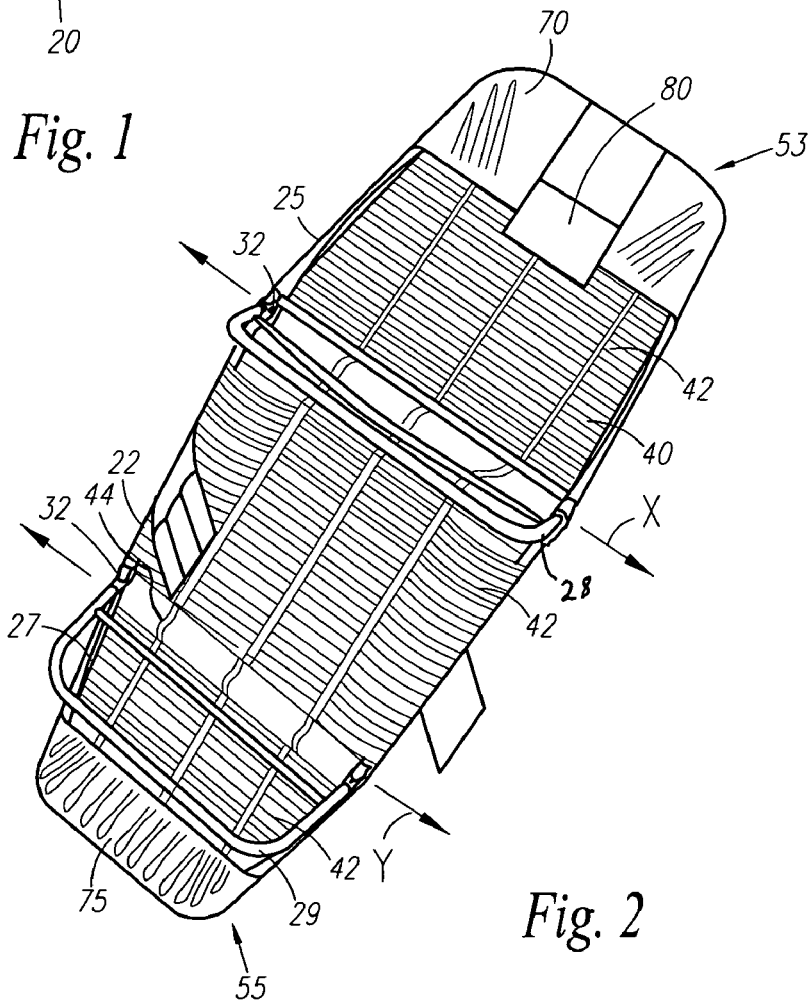
FIG. 2 is a bottom perspective view of the present invention of FIG. 1, according to the preferred embodiment thereof.
Figure 3:
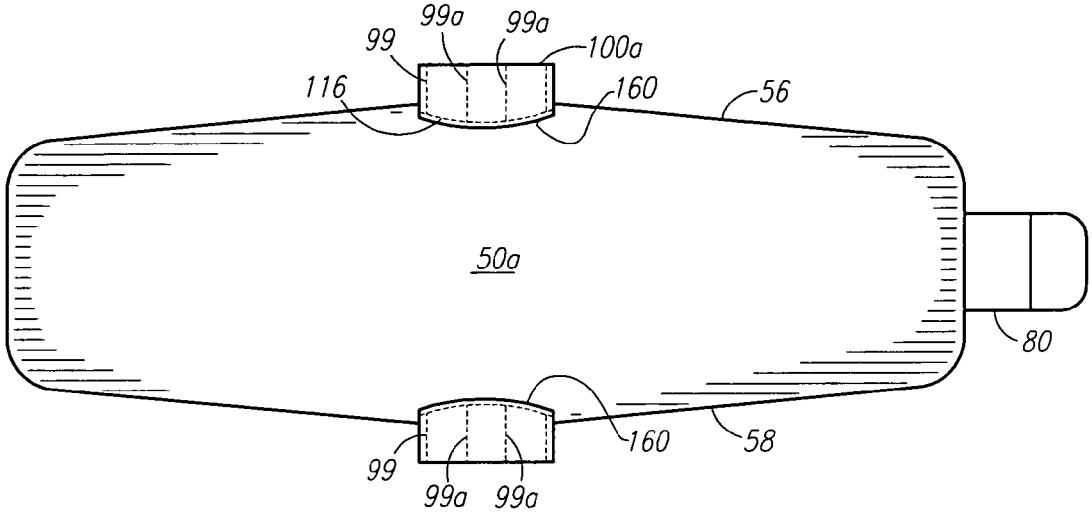
FIG. 3 is a top plan view of the cover, according to the preferred embodiment of the present invention.
Figure 4:
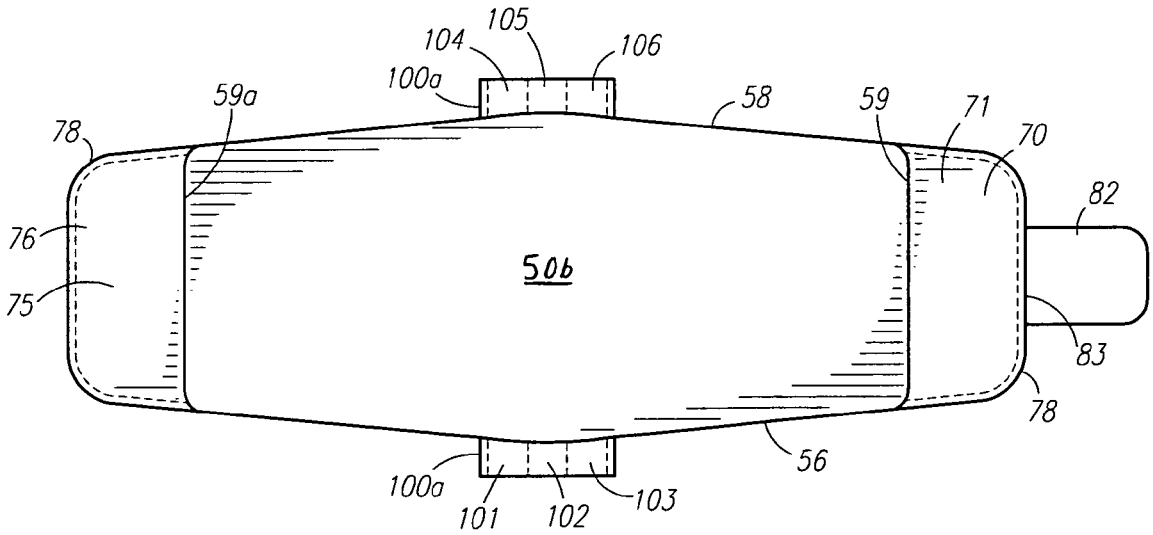
FIG. 4 is a bottom plan view of the cover, according to the preferred embodiment of the present invention.
Figure 5:
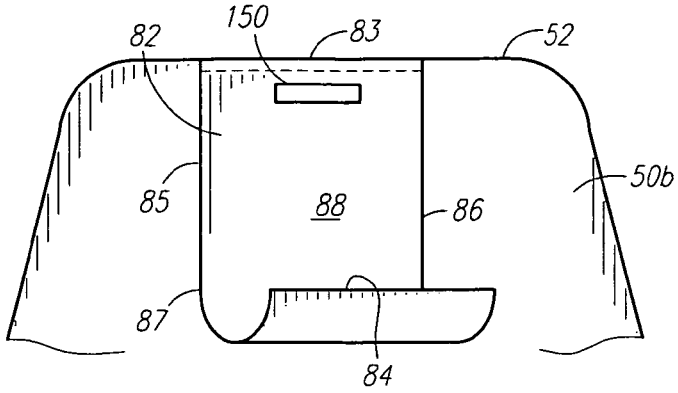
FIG. 5 is a front side elevational view illustrating the extension of the main panel of the auxiliary pocket, according to the preferred embodiment of the present invention.
Figure 6:
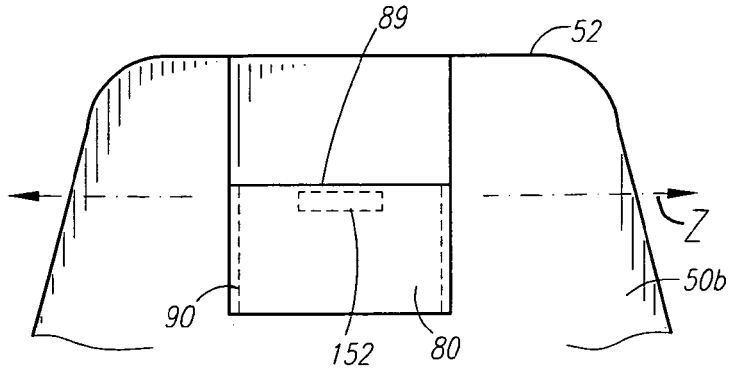
FIG. 6 is a front side elevational view of the auxiliary pocket, according to the preferred embodiment of the present invention.
Figure 7:
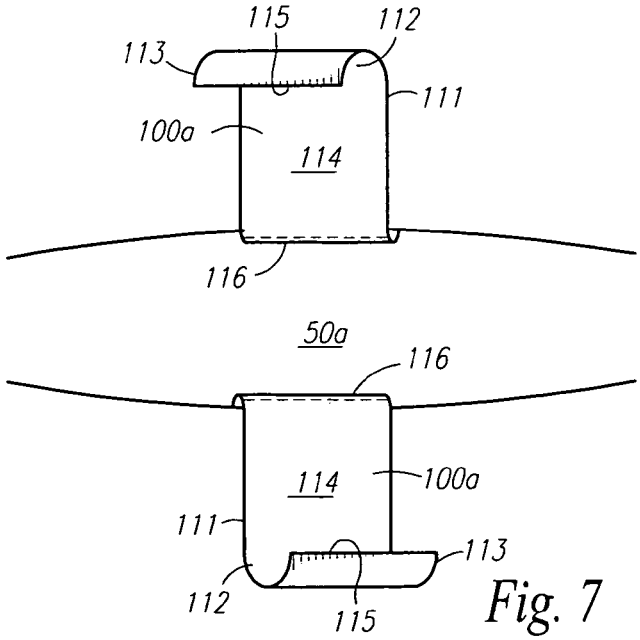
FIG. 7 is a partial top side view of the cover illustrating the continuous panel of the plurality of pockets, according to the preferred embodiment of the present invention.
Figure 8:
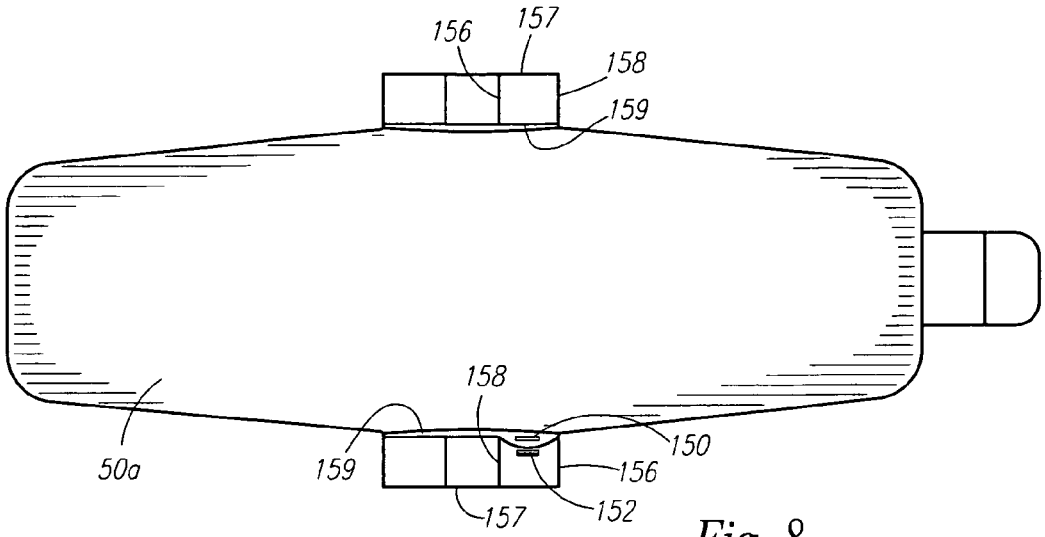
FIG. 8 is a top plan view of the cover illustrating the plurality of pockets, according to the preferred embodiment of the present invention.

Referring now to FIGS. 1-2, the lounge chair 20 includes a central frame section 22 having an upper frame section 25 and a lower frame section 27 adjustably hinged thereto. The upper frame section 25, central frame section 22, and lower frame section 27 are fabricated of aluminum tubing or similar material. The upper frame section 25 and the lower frame section 27 are adapted to be vertically tilted with respect to the central frame section 22 along longitudinal hinge lines X and Y, respectively, in order to position lounge chair 20 in desired angular orientations. The upper frame section 25 and the lower frame section 27 are adapted to be positioned at various desired angular orientations via an adjustment mechanism 30, such as a ratchet mechanism 32.

The lounge chair 20 is supported on a pair of U-shaped, transversely-extending legs 28, 29 being hingedly attached to adjustment mechanism 30, adjacent longitudinal hinge lines X and Y, respectively.

The user is supported atop the lounge chair 20 by a support means 40 comprised of contiguous transverse plastic strips 42 being suitably affixed to each frame section 22, 25, and 27. Support means 40 further comprises spaced, longitudinal straps 44 suitably affixed between plastic strips 42 which provide partial support thereto as well as additional structural integrity concerning user support atop lounge chair 20.

Referring now to FIGS. 1-4, the cover 10 comprises an elongated, substantially rectangular panel 50 having a perimeter defining an anterior end 52 opposing a posterior end 54 and a first side edge 56 opposing a second side edge 58. The rectangular panel 50 includes an upper surface 50*a* opposing a lower surface 50*b*. The panel 50 is slightly tapered at the anterior end 52 and posterior end 54 in order to shapely and sizably conform substantially to an outer periphery of lounge chair 20. The panel 50 is fabricated of a moisture absorbent fabric material such as terry cloth or cotton.

As illustrated in FIG. 1, the cover 10 of the present invention may include various ornamentation 170 or indicia being sewn, silkscreened, adhered via adhesive, appliqued or otherwise suitably attached to the fabric material thereof. The ornamentation 170 is envisioned to be decorative as shown or may carry an advertisement.

The cover 10 further comprises an anterior pocket 70 formed on the lower surface 50*b* at the anterior end 52 of panel 50 being sizably adapted to fit over the U-shaped tubular end 53 defining the upper frame section 25 of lounge chair 20. The cover 10 also comprises a posterior pocket 75 formed on the lower surface 50*b* at the posterior end 54 of panel 50 being sizably adapted to fit over the U-shaped tubular end 55 defining the lower frame section 27 of lounge chair 20.

The anterior pocket 70 extends transversely of the anterior end 52 of panel 50 to adjacent portions of the side edges 56, 58 thereof and is secured to panel 50 via a sewing operation in a manner leaving one open side 59. The posterior pocket 75 extends transversely of the posterior end 54 of panel 50 to adjacent portions of the side edges 56, 58 thereof, and is secured to panel 50 via a sewing operation in a manner leaving one open side 59*a*.

Each pocket 70, 75 comprises a continuous panel 71, 76, respectively, fabricated of a moisture absorbent fabric material such as terry cloth or cotton. Preferably, pockets 70, 75 and panel 50 are fabricated of the same material. Each continuous panel 71, 76 is secured to panel 50 by conventional seams 78 (as at seam 78, FIG. 4) via a sewing method.

Referring now to FIGS. 2-6, an auxiliary pocket 80 is provided, wherein auxiliary pocket 80 functions to both shield user's head or face against sun rays and to allow for the storage of personal articles. The auxiliary pocket 80 comprises a generally elongated, rectangular main panel 82 having an upper end 83 secured via a sewing operation at the anterior end 52 of panel 50 about an upper end of anterior pocket 70 along a linear portion of the seam 78 utilized for securing anterior pocket 70 to the lower surface 50*b* of panel 50. The main panel 82 is fabricated of a moisture absorbent fabric material such as terry cloth or cotton. The auxiliary pocket 80 is formed by a reversely-turned extension 87 of the main panel 82. Opposite sides 85, 86 of the extension 87 are secured to a lower surface 88 of main panel 82 by conventional seams 90 (as at seam 90, FIG. 6) via a sewing method leaving one open side 89. The extension 87 of main panel 82 is reversely-turned in a manner such that the lower end 84 of main panel 82 is positioned proximal to an elongated centerline Z of main panel 82. In the event user desires to shield the head or face against sun rays, user simply drapes the auxiliary pocket 80 over the head or face.

It is envisioned that auxiliary pocket 80 is reclosable by cooperating hook-and-loop fasteners, wherein a strip of the hook portion thereof is affixed to an upper interior surface of the auxiliary pocket 80 below the open side 89 thereof, while the loop portion thereof is affixed to the upper interior surface of each pocket below the open side 89 thereof, opposed to the hook portion strip. The hook-and-loop fasteners are indicated generally by reference numeral 150 and 152, respectively in FIGS. 5 and 6.

Referring now more specifically to FIGS. 1-4 and 7-8, rectangular panel 50 has a plurality of pockets 100 secured thereto along the first side edge 56 and the second side edge 58 thereof. As more clearly shown in FIGS. 4 and 8, six pockets 101, 102, 103, 104, 105, and 106 are depicted, wherein pockets 101, 102, and 103 are adjacently positioned in series, and pockets 104, 105, and 106 are adjacently positioned in series. Each of the pockets 101, 102, 103, 104, 105, and 106 is easily accessible by user when reclining on lounge chair 20. The pockets 101, 102, 103 and 104, 105, 106 are comprised of a continuous panel 100*a* having an upper edge 116 secured by seams 160 to the first side 56 and the second side 58, respectively, of the rectangular panel 50. The continuous panel 100*a* is fabricated of a moisture absorbent fabric material such as terry cloth or cotton. The pockets 101, 102, 103, 104, 105, and 106 are formed by a reversely-turned extension 111 of continuous panel 100*a*. Opposite side edges 112, 113 of extension 111 and a longitudinal edge 115 thereof are secured to an upper surface 114 of continuous panel 100*a* by conventional seams 99 (as at seam 99, FIG. 3) via a sewing method. The extension 111 of continuous panel 100*a* is reversely-turned in a manner such that the longitudinal edge 115 thereof is positioned just below the upper edge 116 thereof. In order to form three separate pockets 101, 102, 103 along the first side 56 of rectangular panel 50, and three separate pockets 104, 105, 106 along the second side 58 of rectangular panel 50, the lower surface 114*a* of extension 111 is secured to the upper surface 114 of continuous panel 100*a* by two seams 99*a* being transversely stitched spatially and equidistant. Thus, the plurality of pockets 100 are formed each having three closed sides 156, 157, and 158 and one open side 159. The plurality of pockets 100 each defines an interior volume within which various personal articles and accessories such as sunglasses, beverages, suntan lotion, cellular phone, car keys, cigarettes, hats, and books may be placed for safe storage.

In addition, being flexible at seams 160, the plurality of pockets 101, 102, 103, 104, 105, 106 can be easily folded atop the upper surface 50*a* of panel 50 so as to allow the cover 10 to be quickly and efficiently folded to a compact configuration, thereby facilitating transport thereof.

It is envisioned that each of the plurality of pockets 101, 102, 103, 104, 105, 106 are reclosable by cooperating hook-and-loop fasteners, wherein a strip of the hook portion thereof is affixed to an upper interior surface of each pocket 101, 102, 103, 104, 105, 106 below the open side 159 thereof, while the loop portion thereof is affixed to the upper interior surface of each pocket below the open side 159 thereof, opposed to the hook portion strip. The hook-and-loop fasteners are indicated generally by reference numeral 150 and 152, respectively in FIG. 8.

Figure 9:
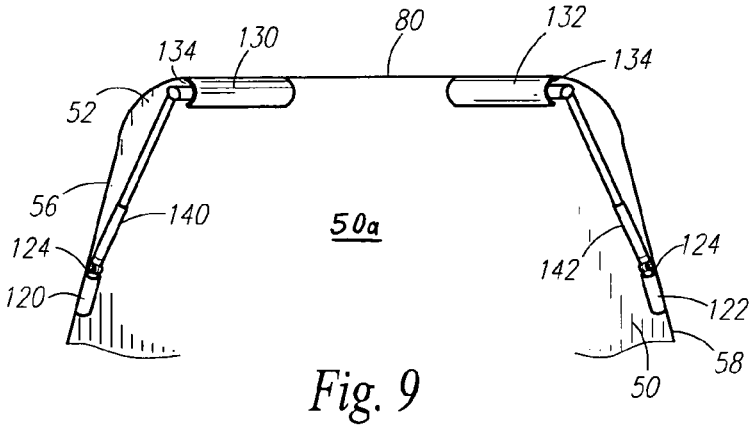
FIG. 9 is a partial front side elevational view according to an alternate embodiment of the present invention.
Figure 10:
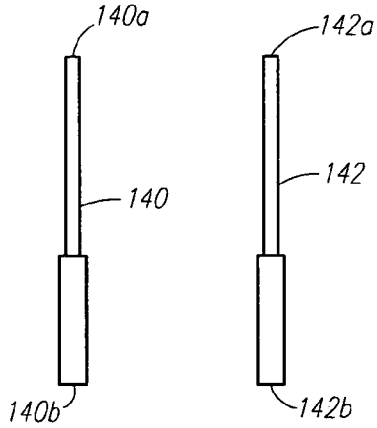
FIG. 10 is a side elevational view of the pair of support members, according to the alternate embodiment of the present invention.
Figure 11:
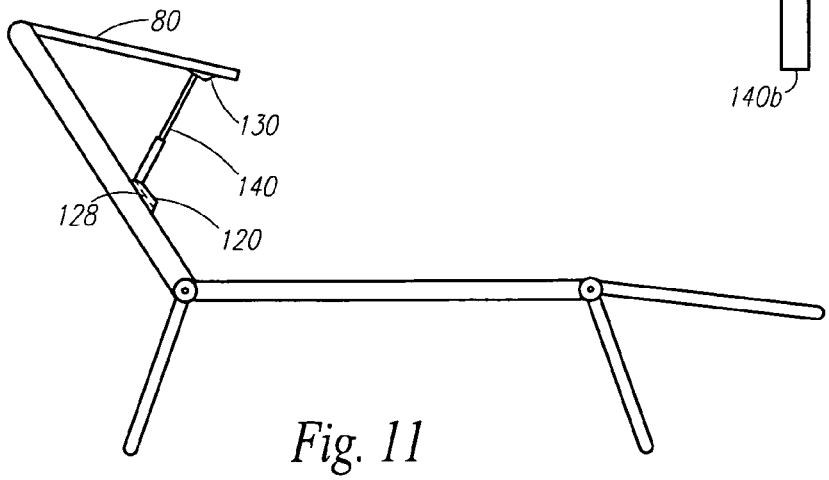
FIG. 11 is a side elevational view of the alternate embodiment of the present invention.

Referring now to FIGS. 9-11, an alternate embodiment of the present invention is disclosed, wherein a first pair of side pockets 120 and 122 is secured to the first side edge 56 and second side edge 58, respectively, of the upper surface 50*a* of panel 50, proximal to the anterior end 52 thereof by conventional seams 128 via a sewing method. The first pair of side pockets 120, 122 is fabricated of a moisture absorbent fabric material such as terry cloth or cotton. Each of the side pockets 120, 122 defines an opening 124 along the upper end thereof which provides direct passage into a small diameter interior volume. The first pair of side pockets 120 and 122 is secured to respective sides 56 and 58 of panel 50 at an angle measuring approximately 40°.

A second pair of side pockets 130 and 132 is secured respectively to opposed upper side edges of the auxiliary pocket 80 by conventional seams 129 via a sewing method. The continuous panel 100*a* is fabricated of a moisture absorbent fabric material such as terry cloth or cotton. Each of the side pockets 130, 132 defines an opening 134 along the lower end thereof which provides direct passage into a small diameter interior volume. The second pair of side pockets 130 and 132 is secured to opposed upper side edges of the auxiliary pocket 80 at an angle measuring approximately 80°.

A pair of support members 140, 142 are disclosed for supporting the auxiliary pocket 80 in a raised position, thereby forming a canopy for shielding a user's head or face against sun rays. Opposed ends 140*b*, 140*a* of first support member 140 are inserted within a first side pocket 120 of the first pair of side pockets 120, 122 and a first side pocket 130 of the second pair of side pockets 130, 132, respectively, and opposed ends 142*b*, 142*a* of second support member 142 are inserted within a second side pocket 122 of the first pair of side pockets 120, 122 and a second side pocket 132 of the second pair of side pockets 130, 132, respectively, thereby supporting auxiliary pocket 80 in a raised, fixed position.

It is envisioned that the pair of support members 140, 142 are telescopically adjustable, thereby allowing auxiliary pocket 80 to be fixedly elevated in a variety of desired angular orientations.

2. Operation of the Preferred Embodiment

To use the present invention, the anterior pocket 70 and the posterior pocket 75 of cover 10 are fitted over respective U-shaped tubular ends 53, 55 of the lounge chair 20. User then places personal items in the plurality of pockets 101, 102, 103, 104, 105, and 106 and auxiliary pocket 80 in an organized or desired manner. Finally, user lies atop the cover 10. In the event user desires to shield his/her head or face against sun rays, user simply drapes the auxiliary pocket 80 over the desired area.

The use of the present invention allows a user to removably attach a cover to a lounge chair, to store personal items in such cover, and to shield the sun's rays in a manner which is quick, easy, and efficient.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A fitted cover for a lounge chair comprising:

an elongated, substantially rectangular panel, said rectangular panel having a perimeter defining an anterior end opposing a posterior end and a first side edge opposing a second side edge, said rectangular panel includes an upper surface opposing a lower surface, and wherein said rectangular panel is slightly tapered at said anterior end and said posterior end in order to shapely and sizably conform substantially to an outer periphery of a lounge chair;

a first pair of side pockets, said first pair of side pockets is secured respectively to said first side edge and said second side edge of said rectangular panel, proximal to said anterior end thereof by seams via a sewing method, wherein each said first pair of side pockets defines an opening along an upper end thereof which provides direct passage into a small diameter interior volume, and wherein said first pair of side pockets is secured respectively to said first side edge and said second side edge of said rectangular panel at an angle measuring approximately 40°;

an anterior pocket, said anterior pocket is formed on said lower surface at said anterior end of said rectangular panel, said anterior pocket being sizably adapted to fit over a U-shaped tubular end defining an upper frame section of the lounge chair;

a posterior pocket, said posterior pocket is formed on said lower surface at said posterior end of said rectangular panel, said posterior pocket being sizably adapted to fit over a U-shaped tubular end defining a lower frame section of the lounge chair;

a plurality of adjacently positioned pockets, said plurality of adjacently positioned pockets is secured along said first side edge and said second side edge of said rectangular panel;

an auxiliary pocket, said auxiliary pocket includes a second pair of side pockets secured respectively to opposed upper side edges of said auxiliary pocket by seams via a sewing method, wherein each said second pair of side pockets defines an opening along a lower end thereof which provides direct passage into a small diameter interior volume, and wherein said second pair of side pockets is secured respectively to said opposed upper side edges of said auxiliary pocket at an angle measuring approximately 80°; and a pair of support members for supporting said auxiliary pocket in a raised position, thereby forming a canopy for shielding a head or a face against sun rays, said pair of support members includes a first support member having a lower end inserted within said side pocket secured to said first side edge of said rectangular panel and an upper end inserted within said side pocket secured to said upper side edge of said auxiliary pocket, and wherein said pair of support members includes a second support member having a lower end inserted within said side pocket secured to said second side edge of said rectangular panel and an upper end inserted within said side pocket secured to said opposed upper side edge of said auxiliary pocket, wherein said pair of support members are telescopically adjustable, thereby allowing said auxiliary pocket to be fixedly elevated in a variety of desired angular orientations.

2. The fitted cover for a lounge chair of claim 1, wherein said rectangular panel includes ornamentation for purposes of decoration or advertisement.

* * * * *